US012336671B2

(12) United States Patent
Achton

(10) Patent No.: US 12,336,671 B2
(45) Date of Patent: Jun. 24, 2025

(54) PRODUCT DISPENSER COMPRISING FIRST AND SECOND HOUSING PARTS AND A LOCK MECHANISM

(71) Applicant: Achton A/S, Korsør (DK)

(72) Inventor: Kim Achton, Korsør (DK)

(73) Assignee: Achton A/S, Korsør (DK)

( * ) Notice: Subject to any disclaimer, the term of this patent is extended or adjusted under 35 U.S.C. 154(b) by 189 days.

(21) Appl. No.: 18/080,787

(22) Filed: Dec. 14, 2022

(65) Prior Publication Data

US 2023/0210320 A1 Jul. 6, 2023

(30) Foreign Application Priority Data

Dec. 16, 2021 (GB) ..... 2118258

(51) Int. Cl.
*A47K 10/38* (2006.01)
*A47K 10/32* (2006.01)

(52) U.S. Cl.
CPC ..... *A47K 10/38* (2013.01); *A47K 2010/3233* (2013.01); *A47K 2010/3246* (2013.01)

(58) Field of Classification Search
CPC ..... A47K 10/38; A47K 2010/3233; A47K 2010/3246; A47K 10/32; A47K 5/12; A47K 10/36; A47K 10/3681; E05B 2015/0468; E05B 35/008; E05C 3/16; E05C 19/06; E05C 19/10
See application file for complete search history.

(56) References Cited

U.S. PATENT DOCUMENTS 4,500,120 A * 2/1985 Ridgewell ..... E05B 65/0858 292/19
4,662,664 A * 5/1987 Wendt ..... A47K 10/3687 292/87
4,958,864 A 9/1990 Fischer et al.
(Continued)

FOREIGN PATENT DOCUMENTS

GB 2080396 A 2/1982
WO WO2009/123509 A1 10/2009

OTHER PUBLICATIONS

Search and Examination Report Under Sections 17 and 18(3), dated Jun. 15, 2022 in connection with GB2118258.9.
(Continued)

*Primary Examiner* — Vishal Pancholi
(74) *Attorney, Agent, or Firm* — Lippes Mathias LLP

(57) ABSTRACT

A product dispenser comprises first and second housing parts (11, 12) and a lock mechanism. The lock mechanism is configured to lock the first and second housing parts together with one another, and comprises: a cradle (30), the cradle housing at least one lock arm (20); an aperture (80) through the first housing part and leading into the cradle; a rotatable guiding part (40) located within the aperture and the cradle; a key (70) that cooperates with the rotatable guiding part; and a mating part of the second housing part, the mating part configured to engage with an end (21) of each lock arm to lock the first and second housing parts together, and wherein the key is rotatable to rotate the rotatable guiding part within the aperture and actuate each lock arm to disengage from the mating part, unlocking the first and second housing parts from one another.

18 Claims, 5 Drawing Sheets

(56) References Cited

U.S. PATENT DOCUMENTS

| | | | | |
|---|---|---|---|---|
| 8,561,441 | B2 * | 10/2013 | Herrmann | E05C 3/30 292/108 |
| 8,573,715 | B1 | 11/2013 | Jackman et al. | |
| 2019/0330891 | A1 | 10/2019 | Paré | |

OTHER PUBLICATIONS

Extended Search Report, dated May 10, 2023 in connection with European Application No. 22210631.2.

* cited by examiner

PRODUCT DISPENSER COMPRISING FIRST AND SECOND HOUSING PARTS AND A LOCK MECHANISM

FIELD OF THE INVENTION

The present invention relates to a product dispenser comprising first and second housing parts and a lock mechanism.

BACKGROUND OF THE INVENTION

Product dispensers are used in a variety of public or private locations to dispense products to people. Product dispensers include but are not limited to devices such as paper towel dispensers and soap dispensers. Product dispensers require periodic refilling when all the product has been dispensed, and may be locked after filling has taken place to prevent unauthorised removal or replacement of the product inside the dispenser.

There is a desire to make opening of the product dispenser for product replacement as easy as possible, yet to guard against opening by unauthorised users. Known product dispensers sometimes provide a separate key to allow the dispenser to be locked and unlocked, however keys are susceptible to being lost. Both authorised users who have lost the key and unauthorised users without a key may be tempted to force the product dispenser open without the key, causing damage to the dispenser.

Some known locking mechanisms are also quite complex and expensive to manufacture, and so there is also a need for a simple locking mechanism with a low number of parts that are easy to manufacture.

It is therefore an object of the invention to provide an improved product dispenser.

SUMMARY OF THE INVENTION

According to one aspect the invention, there is provided a product dispenser comprising first and second housing parts and a lock mechanism configured to lock the first and second housing parts together with one another. The first housing part may for example be a base for mounting the product dispenser to a wall, and the second housing part may be a cover which can be opened out from the base to enable replacement of the product inside the dispenser. The lock mechanism comprises a cradle housing at least one lock arm; an aperture through the first housing part and leading into the cradle; a rotatable guiding part located within the aperture and the cradle; a key that cooperates with the rotatable guiding part; and a mating part of the second housing part, the mating part configured to engage with end(s) of the lock arm(s) to lock the first and second housing parts together. The key is rotatable to rotate the rotatable guiding part within the aperture and actuate the lock arm(s) to disengage from the mating part, unlocking the first and second housing parts from one another.

Since the lock arm(s) engage with the mating part, the mating part is securely held by the lock arm(s) in the engaged position, and there is minimal opportunity for an unauthorised person to forcibly open the product dispenser by pulling and/or twisting the second housing part away from the first housing part. The lock arm(s) can be moved from an engaged position in which the lock arm(s) engage the mating part, to a disengaged position in which the lock arm(s) disengage from the mating part, by rotating the rotatable guiding part with the key. There may for example be two of the lock arms.

Preferably, the end(s) of the lock arm(s) each comprise a latch configured to latch against surfaces of the mating part when the surfaces are brought in between the lock arm(s).

Each lock arm may comprise a flexible strip of material extending from a base to the end of the lock arm, wherein the base is fixed in position and the end is movable as the flexible strip of material is flexed. Preferably, the flexible strip of material is substantially unflexed when the lock arm is engaged with the mating part, and is flexed to move the end of the lock arm out of engagement from the mating part when the product dispenser is to be opened. Then, the strip of material spends most of the time in the substantially unflexed state and so does not lose its original shape over time.

The flexible strip of material may comprise a length portion that is adjacent to the rotatable guiding part and that defines a cam surface. The rotatable guiding part and/or the key may be configured to cam along the cam surface to flex the end of the lock arm out of engagement with the mating part when the rotatable guiding part and key are rotated. Preferably, the length portion comprises a stopper at an end of the cam surface, the stopper configured to prevent camming of the rotatable guiding part and/or the key past the cam surface, thereby preventing over-flexing of the flexible strip of material. Over-flexing of the flexible strip of material, for example past the elastic limit of the flexible strip of material, could reduce the ability of the locking arm to securely engage the mating part and to resist forcible opening of the product dispenser.

The key may be separate from the rotatable guiding part and the key may comprise at least one leg. Each leg may be configured to press against a respective one of the at least one lock arm to actuate the at least one lock arm when the key is inserted into the rotatable guiding part and rotated.

The key may comprise two legs, each leg configured to press against the camming surface of a respective one of two of the lock arms as the key and the rotatable guiding part are rotated to actuate the lock arms. Accordingly, the rotatable guiding part may be configured so the rotatable guiding part itself does not press against the lock arms when rotated, and so does not disengage the lock arms from the mating part should it be rotated by an unauthorised user without the key. The key is typically separate from the rotatable guiding part and is carried by an authorised user who may use the key to open the product dispenser when required.

The key may be in an unactuated position when the legs are mid-way along the cam surface, with the lock arms in the engaged position. The key may therefore be rotated in any direction, i.e. clockwise or anticlockwise, in order to reach an actuated position in which the legs have been moved along the cam surface, moving the lock arms into the disengaged position.

Preferably, the key comprises a body portion from which the two legs extend, and the rotatable guiding part is configured to receive the two legs, leaving the body portion exposed so that the user can grasp and turn the body portion to rotate the rotatable guiding part.

Alternatively, the key may be inseparable from the rotatable guiding part, for example integrally formed as part of the rotatable guiding part, so that there is no risk of the key being lost. This may be suitable for situations in which there is no risk of an unauthorised user attempting to open the product dispenser, for example when the product dispenser is installed in a private location, and the user(s) do not wish to carry keys which could become lost.

The cradle housing the two lock arms may comprise a base wall and two side walls extending perpendicular from the base wall towards the first housing part, the two lock arms located between the first housing part and the base wall, and between the two side walls. Thus, the cradle may be located beneath the first housing part so that it is not accessible from the exterior of the product dispenser when the first and second housing parts are closed together. The first housing part may be substantially planar in the region adjacent to the lock mechanism, and the base wall may be in a plane that is parallel to the plane of the first housing part over that region.

The bases of the two lock arms may comprise one or more latches which latch against rear and/or the side walls of the cradle and keep the bases of the latch arms in place. The bases of the lock arms are preferably integrally formed with one another, and may comprise an intermediate portion and two latch portions at opposing ends of the intermediate portion, the strips of flexible material extending from the ends of the intermediate portion to the ends of the lock arms. The two latch portions may be configured to latch into or against a rear edge of the two side walls of the cradle.

The two side walls may block the two lock arms from flexing apart from one another beyond the elastic limits of the lock arms, to prevent the locking arms from losing their ability to securely engage the mating part and to resist forcible opening of the product dispenser. The cradle may be sized so that a distance from each lock arm in the engaged position to the corresponding adjacent side wall is a same distance that the lock arm is moved by from the engaged to the disengaged position. Accordingly, each lock arm may contact the corresponding adjacent side wall once the key has been fully rotated to rotate the rotatable guiding part and disengage the lock arms from the mating part.

The key may be separable from the rotatable guiding part, so that the key can be stored away or carried only by persons authorised to open the dispenser. Alternatively, the key may be inseparable from the rotatable guiding part, for example the key and the rotatable guiding part may be integrally formed with one another, so there is no risk of the key becoming lost and anyone will be able to open the dispenser.

The rotatable guiding part may comprise a disk that locates inside the aperture of the first housing part and a stem that extends from the disk into the cradle, the stem located between the two lock arms. The stem and the disk each have a central axis and the central axes are preferably aligned with one another. When the rotatable guiding part is rotated within the aperture, the stem and the disk may each rotate about their central axis. The stem preferably has a smaller diameter than the disk.

When the key is separable from the rotatable guiding part, the disk may comprise two apertures configured to receive the two legs of the key upon insertion of the key into the rotatable guiding part, each leg configured to press against the cam surfaces of the lock arms to disengage the lock arms from the mating part when the key is rotated. The two legs of the key may reside in the cradle at the exterior of the stem on opposing sides of the stem from one another. When the key is inseparable from the rotatable guiding part, the key may comprise surface(s) of the stem that press against the cam surfaces of the lock arms to disengage the lock arms from the mating part.

The disk and the aperture may comprise a restricting mechanism that is configured to restrict an angular range of rotation of the disk within the aperture, thereby preventing over-rotation and over-flexing of the lock arms. Over-flexing of the lock arms, for example past the elastic limit of the lock arms, could reduce the ability of the lock arms to securely engage the mating part and to resist forcible opening of the product dispenser.

The restricting mechanism may comprise a protrusion and a slot, wherein the protrusion is configured to travel along the slot as the disk is rotated, and wherein the slot has an end configured to limit the travel of the protrusion, the limited travel of the protrusion limiting the rotation of the disk. For example, the slot may be formed in the first housing part along a perimeter of the aperture and the protrusion may be formed as a radially outward protrusion of the disk, or the slot may be formed in the disk along a perimeter of the disk and the protrusion may be formed as radially inward protrusion of the first housing part into the aperture.

The stem may comprise two latch arms that extend through a hole in the base wall of the cradle and latch against a surface of the base wall adjacent the hole. Thus, the lock mechanism may be simply constructed by pushing the latch arms into the cradle until the latches of the bases latch against rear and/or the side walls of the cradle, and then pushing the stem of the rotatable guiding part through the aperture and into the cradle until the latch arms of the stem latch against the base wall of the cradle.

The second housing part may be configured to overlap with the first housing part on an exterior side of the first housing part when the first and second housing parts are closed together and optionally locked by the lock mechanism. Therefore, an unauthorised user pushing downwards on the exterior of the second housing part will not be able to move the mating part out of engagement from the lock arms, since the first housing part with the cradle and lock arms would be pushed downwards too by the overlap of the second housing part over the first housing part.

To provide the overlap, the first housing part may comprise an edge adjacent the aperture, the edge comprising a recess running along the edge, the recess being on the exterior side of the first housing part, and the second housing part may comprise a lip configured to fit into the recess of the first housing part when the first and second housing parts are closed together.

According to another aspect of the invention, there is provided a method of manufacturing the product dispenser. The method comprises providing the first housing part with the cradle; sliding each lock arm into the cradle until one or more latches at the bases of the at least one lock arm latch against one or more walls of the cradle to hold the bases in a fixed position within the cradle; and sliding the rotatable guiding part through the aperture and into the cradle until the one or more latches of the rotatable guiding part latch against one or more walls of the cradle.

DETAILED DESCRIPTION

Embodiments of the invention will now be described by way of non-limiting example only and with reference to the accompanying drawings, in which.

The figures are not to scale, and same or similar reference signs denote same or similar features.

Figure 1:
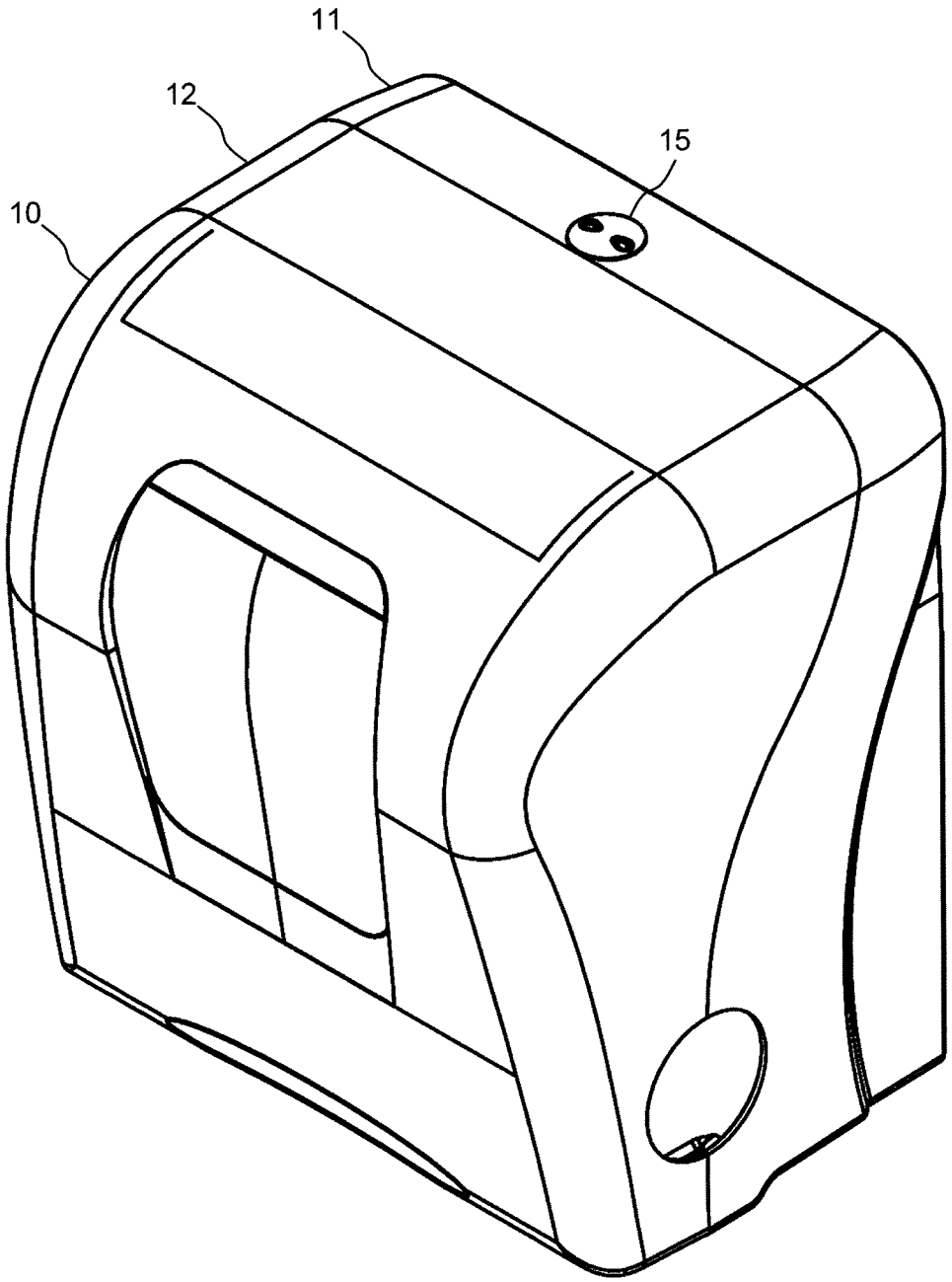
FIG. 1 shows a perspective schematic diagram of a product dispenser in a closed position, in accordance with an embodiment of the invention.

The schematic diagram of FIG. 1 shows a product dispenser 10, comprising a first housing part 11, a second housing part 12, and a lock mechanism 15. The product dispenser is a paper towel dispenser, however the type of product to be dispensed may vary in alternative embodiments and is not important. The first housing part 11 may be a base for mounting the product dispenser to a wall, and the second housing part 12 may be a cover which can be opened out from the base to enable replacement of the product inside the dispenser.

Figure 2:
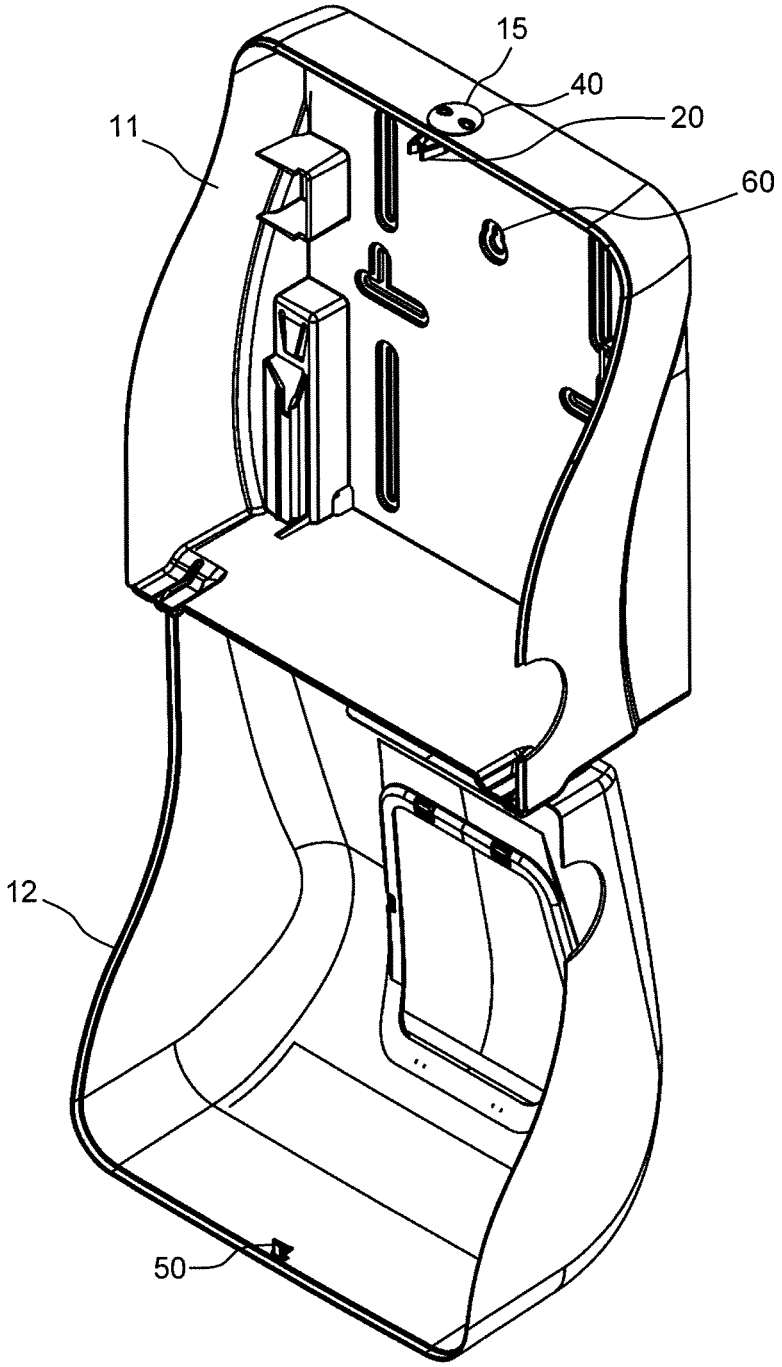
FIG. 2 shows a perspective schematic diagram of the product dispenser of FIG. 1 in an open position for replenishing a product supply held within the dispenser.

FIG. 1 shows the product dispenser 10 in a closed position with the first housing part 11 closed together with the second housing part 12, the first and second housing parts being locked in the closed position by the lock mechanism 15. The lock mechanism may be actuated to unlock the second housing part 12 from the first housing part 11, allowing the second housing part 12 to swing outwardly from the first housing part 11, as shown in the schematic diagram of FIG. 2.

The lock mechanism 15 may be situated at the top of the dispenser, with the second housing part 12 pivoting open from the first housing part 11 about a pivot axis at the bottom of the dispenser when the lock mechanism is actuated, and allowing a roll of paper towelling (not shown in FIGS.) to be replaced inside the product dispenser. The lock mechanism may comprise a rotatable guiding part 40 and two lock arms 20 positioned at the top of the first housing part 11, and a mating part 50 positioned at the top of the second housing part 12, the two lock arms 20 configured to latch against the mating part 50 to lock the first and second housing parts 11 and 12 together with one another.

Figure 3:
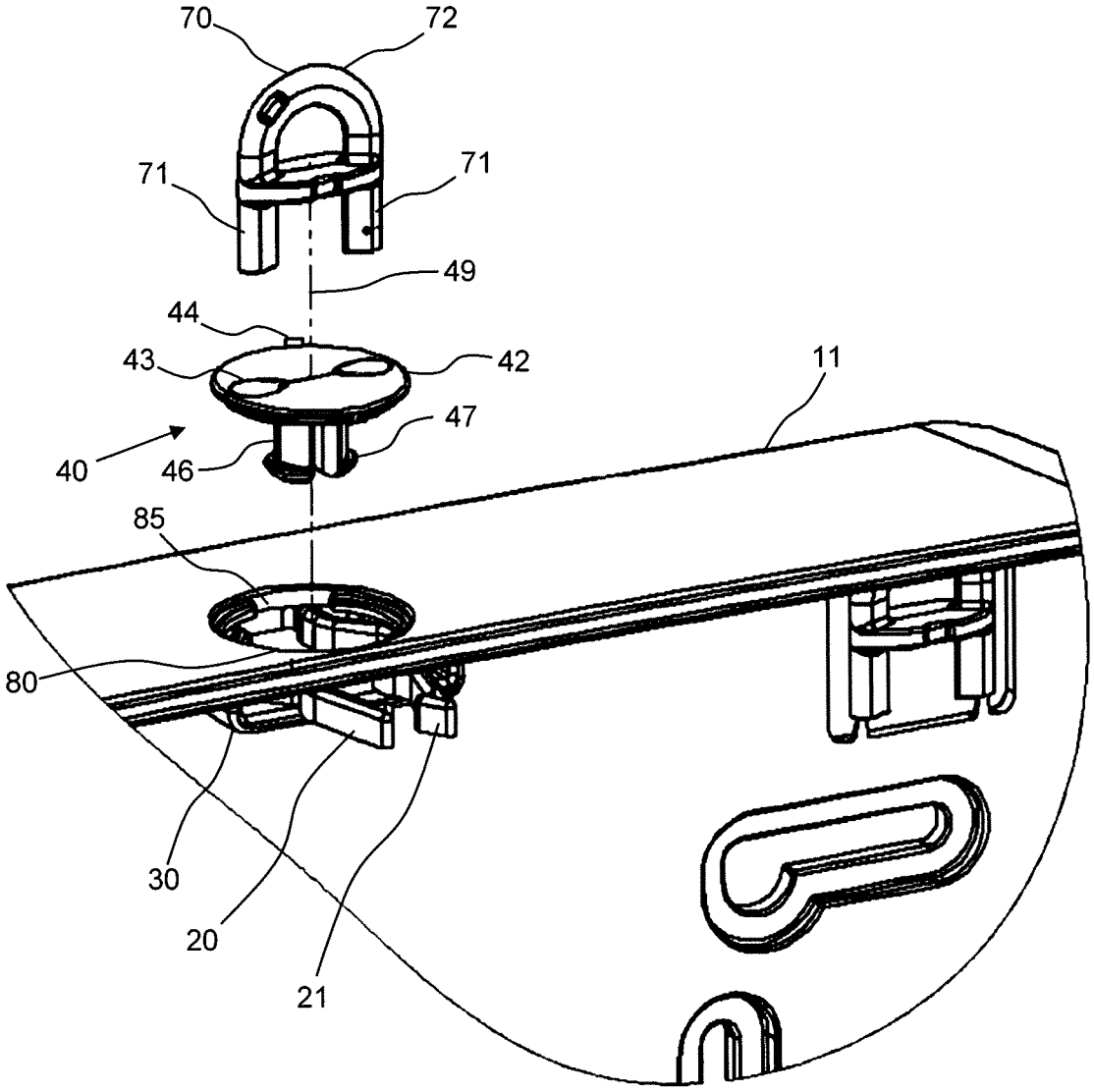
FIG. 3 shows an enlarged schematic diagram of a lock mechanism of the product dispenser of FIG. 1.

The schematic diagram of FIG. 3 shows an enlarged view of the lock mechanism at the first housing part 11. The lock mechanism may comprise a key 70, the rotatable guiding part 40, the two lock arms 20, and a cradle 30 that houses the two lock arms. The key 70 may comprise a main body 72 and two legs 71 that extend outward of the main body 72, the legs 71 being separate and independent of one another. In this embodiment, the key 70 is in the shape of a capital 'A'. The top part of the 'A' forms the main body 72, the main body 72 providing a convenient part of the key that a user can grasp to hold and turn the key in operation.

The rotatable guiding part 40 may comprise a disk 42 and a stem 46 that extends axially from the disk 42, the disk 42 and the stem 46 both aligned along a central axis of rotation 49. The stem 46 may comprise two parts which each terminate at an end having a latch 47, the two parts being able to flex towards one another. The disk 42 and stem 46 may be integrally moulded from a plastics material, although could be formed of other materials if desired. The stem 46 may have a smaller diameter than the disk 42, and the disk 42 may comprise two apertures 43 that lead through the disk to regions at the exterior of the stem 46. The two apertures 43 may be positioned 180 degrees apart from one another about the central axis 49 of the disk.

The first housing part 11 may comprise an aperture 80 passing through the first housing part and leading into a cradle 30, the cradle 30 being formed directly beneath the first housing part 11. The cradle 30 may be integrally formed with the first housing part 11, or could be fixed to the first housing part 11 after the cradle 30 has been formed. The cradle 30 may house the two lock arms 20, and the two lock arms 20 may each have a latch 21 at their ends for latching with the mating part 50 when the first and second housing parts are closed together with one another. The aperture 80 may be in the shape of a circle, and may comprise a slot 85 extending along the perimeter of the circle, effectively increasing the radius of the circle over the angular range of the slot.

The lock mechanism may be simply manufactured by inserting the lock arms 20 into the cradle 30, as shown, and then inserting the rotatable guiding part into the aperture 80. The stem 46 may fit in between the two lock arms 20, and the disk 42 may fit in the aperture 80, with an upper surface of the disk 42 laying substantially flush with an upper surface of the first housing part 11. Accordingly, the disk 42 may have a radius that substantially matches the radius of the aperture 80, so that the disk fits neatly inside the aperture and is retained by the sides of the aperture 80 to rotate about the central axis 49.

The disk 42 may comprise a radially outward protrusion 44 which increases a radius of the disk over a small angular range, the angular range being less than the angular range of the slot 85. The radially outward protrusion 44 may fit inside the slot 85 when the rotatable guiding part 40 is fitted into the aperture 80 and cradle 30. The radially outward protrusion 44 and the slot 85 may together form a restricting mechanism that restricts a maximum angular range of rotation of the disk 42 to the maximum angular range of movement of the protrusion 44 along the slot 85. In an alternate embodiment, the slot could be formed in the disk along a perimeter of the disk instead of in the aperture, and the protrusion could be formed as radially inward protrusion of the first housing part into the aperture.

The two apertures 43 of the disk 42 may be sized and shaped with a same size and shape as a cross-section of the legs 71 of the key, allowing the legs 71 to fit through the apertures 43 and into the cradle 30. The legs 71 of the key then reside in the cradle, adjacent the exterior of the stem 46 on opposite sides of the stem 46, and the main body 72 of the key may be turned to rotate the rotatable guiding part 40. In this embodiment the key 70 can be removed from the rotatable guiding part 40 whenever desired, however in an alternate embodiment to prevent any risk of losing the key, the key may be permanently fixed in the rotatable guiding part 40, for example by adhesive, or by forming the key and the rotatable guiding part integrally with one another.

Figure 4:
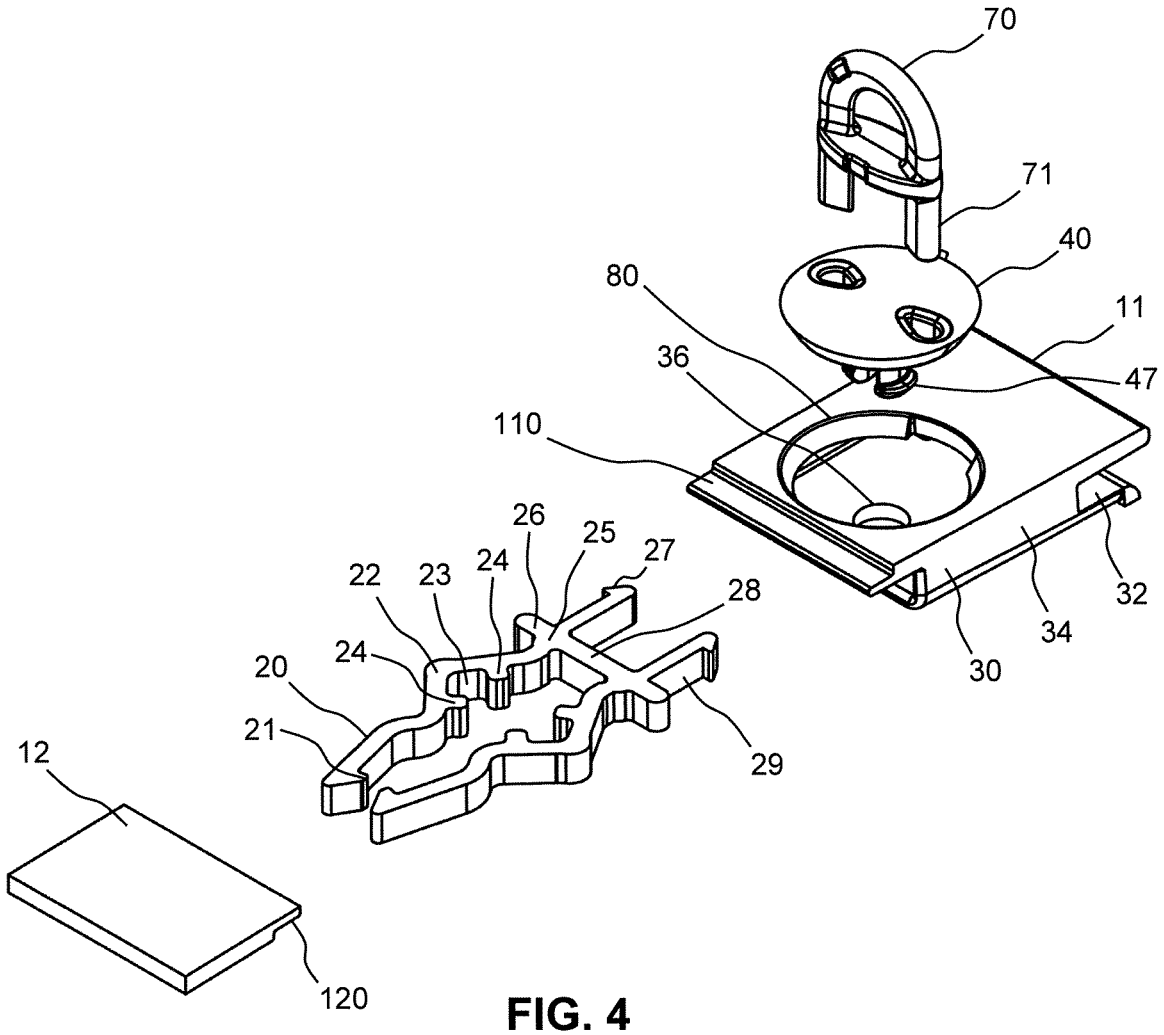
FIG. 4 shows an exploded schematic diagram of the lock mechanism of FIG. 3.

The schematic diagram of FIG. 4 shows an exploded diagram of the lock mechanism in which further details of the lock mechanism can be seen. As shown, the cradle 30 may comprise a base wall 32 and two opposing side walls 34. The base wall 32 may be in a parallel plane to the first housing part 11, and the side walls 34 may each extend from the base wall 32 to the first housing part 11 at opposite sides of the cradle 30. The two lock arms 20 may therefore be housed between the base wall 32 and the first housing part 11, and between the two opposing side walls 34.

The base wall 32 comprises a hole 36 for receiving the stem 46 of the rotatable guiding part 40, and the latches 47 pass through the hole 36 and latch against a surface of the base wall 32 at the exterior of the cradle and around the periphery of the hole 36. The rotatable guiding part 40 may therefore be a snap-fit into the aperture 80 and cradle 30, the latches 47 preventing the rotatable guiding part 40 from being withdrawn from the aperture 80 and cradle 30.

The sides of the aperture 80 may have a chamfered or grooved profile that narrows a diameter of the aperture 80 in a direction towards the cradle. The chamfer or grooved profile may provide a bearing surface upon which the rotatable guiding part 40 may rotate, and may restrain the rotatable guiding part 40 from moving axially downward. The latches 47 may restrain the rotatable guiding part from moving axially upward, and so the rotatable guiding part 40 may be held at a fixed axial location.

The first housing part 11 may have an edge adjacent the aperture 80, the edge comprising a recess 110 running along the edge, the recess being on the exterior side of the first housing part. The second housing part 12 may comprise a lip 120 configured to fit into the recess 110 of the first housing part when the first and second housing parts are closed together, thereby preventing the second housing part from being moved downward relative to the first housing part 11.

The lock arms 20 may each extend from a base 25 to the latch 21 at the end of the lock arm. Each lock arm may have a length portion 22 extending for at least part of the length of the lock arm from the base to the end of the lock arm. The length portion may be curved to define a cam surface 23, and the curvature of the length portion may curve the lock arm around the stem 46 of the rotatable guiding portion. The cam surface 23 may end at stoppers 24, which may be positioned at opposite ends of the length portion 22.

The base 25 of each lock arm 20 may comprise a blocking arm 26 that extends in a direction generally perpendicular to a direction in which the lock arm extends from the base to the end of the lock arm, and may also comprise a latch arm 29 with a latch 27 at an end of the latch arm. The blocking arm 26 and the latch 27 may capture a rear wall 38 (see FIG. 6) of the cradle 30 between them. The blocking arm 26 and the latch arm 29 may be perpendicular to one another.

Each lock arm 20 may comprise a flexible strip of material extending from the base 25 to the end of the lock arm, and may for example be formed of plastics or sprung steel material.

The lock arms 20 may be symmetrical with their cam surfaces 23 facing towards one another, and the two bases 25 of the lock arms may be connected together by an intermediate portion 28. The lock arms 20 may therefore be integrally formed with one another, for example by moulding them from a plastics material, or stamping them from a metal sheet.

Figure 5:
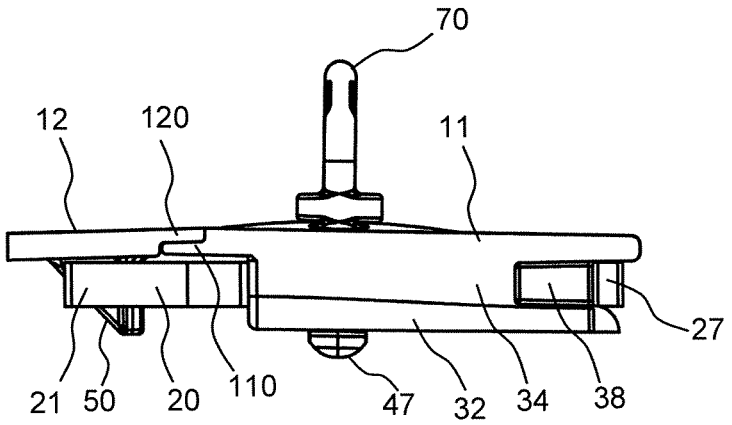
FIG. 5 shows a schematic side diagram of the lock mechanism of FIG. 3 when the product dispenser is in the closed position.

FIG. 5 shows a schematic side diagram of the lock mechanism 15 when the product dispenser is in the closed position. The lip 120 of the second housing part 12 may overlap the first housing part 11 in the closed position, the lip 120 fitting into the recess 110 of the first housing part 11. The lock arms 20 may receive the mating part 50 (also see FIG. 2) in between the lock arms 20, and the latches 21 may latch against surfaces of the mating part 50, capturing the mating part 50 between the lock arms 20 and preventing the mating part 50 from being withdrawn from the lock arms, thereby locking the first and second housing parts together with one another.

The stem 46 of the rotatable guiding part has been fully inserted through the aperture 80 and into the cradle 30, with the latches 47 at the end of the stem having passed through the hole 36 in the base wall 32 of the cradle to latch against a surface of the base wall 32 at the exterior of the cradle and around the periphery of the hole 36.

The cradle 30 may comprise the rear wall 38, and the latches 27 at the bases of the lock arms 20 may latch against the rear wall 38 to fix the bases of the latch arms in position within the cradle 30. As seen in the schematic cross-sectional diagram of FIG. 6, the rear wall 38 may have a first inward extension 38*a* that extends inwardly between the first housing part 11 and the base wall 32, perpendicular to the side walls 34, and a second rearward extension 38*b* that extends rearwardly between the first housing part 11 and the base wall 32, parallel to the side walls 34. Accordingly, the first inward extension 38*a* and the second inward extension 38*b* may be perpendicular to one another.

The rear wall 38 may be in two portions, which are separated from one another by a gap 39 between the two portions. Each of the two portions has the first inward extension 38*a* and the second rearward extension 38*b*. The gap 39 may be defined between the second rearward extensions 38*b*, and the second rearward extensions 38*b* may be parallel to one another, such that the width of the gap 39 is constant along substantially the whole lengths of the second rearward extensions 38*b*.

Figure 6:
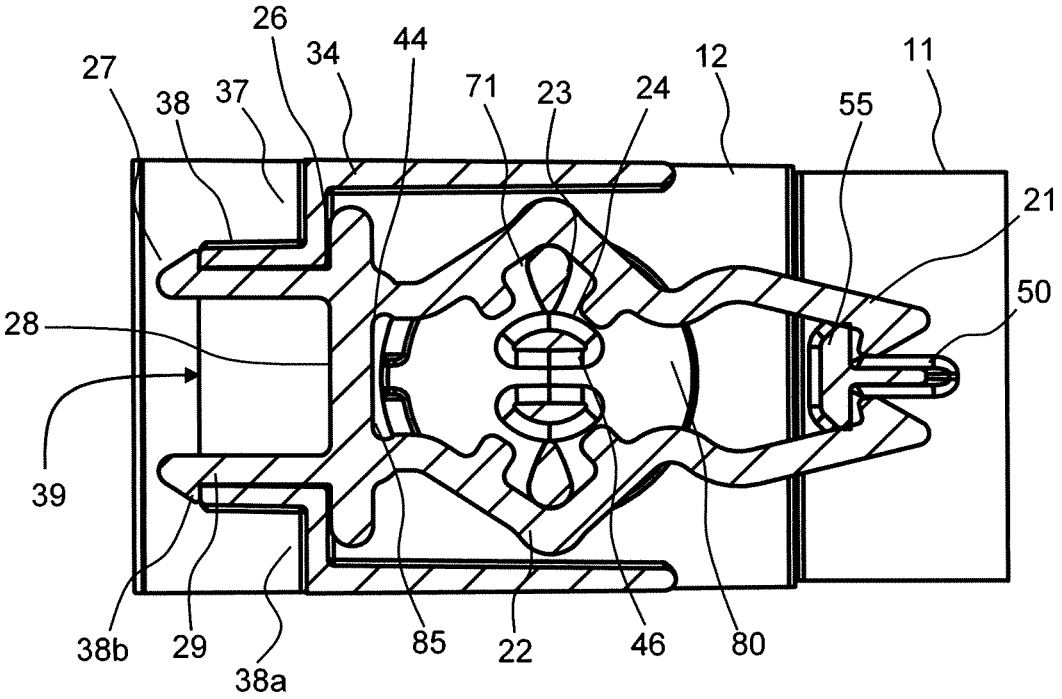
FIG. 6 shows a schematic cross-sectional diagram of the lock mechanism of FIG. 3 when the product dispenser is in the closed position.

FIG. 6 shows the lock arms 20 in the engaged position, in which the lock arms 20 engage with the mating part 50 and lock the first and second housing parts 11 and 12 together with one another. As shown, the lock arms 20 have been inserted into the cradle 30 from the front, until the blocking arms 26 of the lock arms abut against the front surfaces of the first inward extensions 38*a*, and the latches 27 of the lock arms latch against ends of the second rearward extensions 38*b*. The blocking arms 26 and the latches 27 may thereby capture the second rearward extensions 38*b* between them, and prevent forward/rearward movement of the lock arms within the cradle 30. The latch arms 29 may run parallel to the second rearward extensions 38*b* within the gap 39, and may contact the second rearward extensions 38*b*. The intermediate portion 28 that joins the bases of the lock arms 20 together may prevent the bases of the lock arms from moving relative to one another, keeping the latch arms 29 in contact with the second rearward extensions 38*b*, and preventing side-to-side movement of the bases of the lock arms 20 within the cradle 30.

The sidewalls 34 and the latch arms 20 may have substantially a same height as one another so that the first housing part 11 and the base wall 32 constrain the lock arms 20 to flexing in a direction towards and away from one another, preventing them from flexing perpendicular to that direction, i.e. preventing them from flexing up and down. This helps prevent the lock mechanism from being forcibly disengaged by a person pulling or twisting the first and second housing parts relative to one another.

As shown in FIG. 6, the mating part 50 may be held between the lock arms 20, and may comprise surfaces 55, the latches 21 at the ends of the lock arms latching against the surfaces 55 in between the lock arms 20. The surfaces 55 may be substantially perpendicular to the direction of extension of the lock arms from the bases 25 to the ends having the latches 21. The lock arms 20 are in an unflexed state in FIG. 6, and the length portions 22 of the lock arms may curve around the stem 46 of the rotatable guiding part, as shown.

FIG. 6 shows a situation in which the key 70 has been inserted into the rotatable guiding part, and the legs 71 of the key are visible on opposing sides of the stem 46. Each leg 71 may be sized to fit in between the exterior of the stem 46 and the length portion 22 of the corresponding lock arm. The key 70 is in an unactuated position within the rotatable guiding part, and so the lock arms engage the mating part 50. In this unactuated position, the leg 71 may contact the cam surface 23 of the length portion 22, preferably mid-way along the cam surface 23 at the point of greatest distance of the cam surface from the stem 46. The radially outward protrusion 44 may also be mid-way along the slot 85 when the key is in the unactuated position, as shown.

Figure 7:
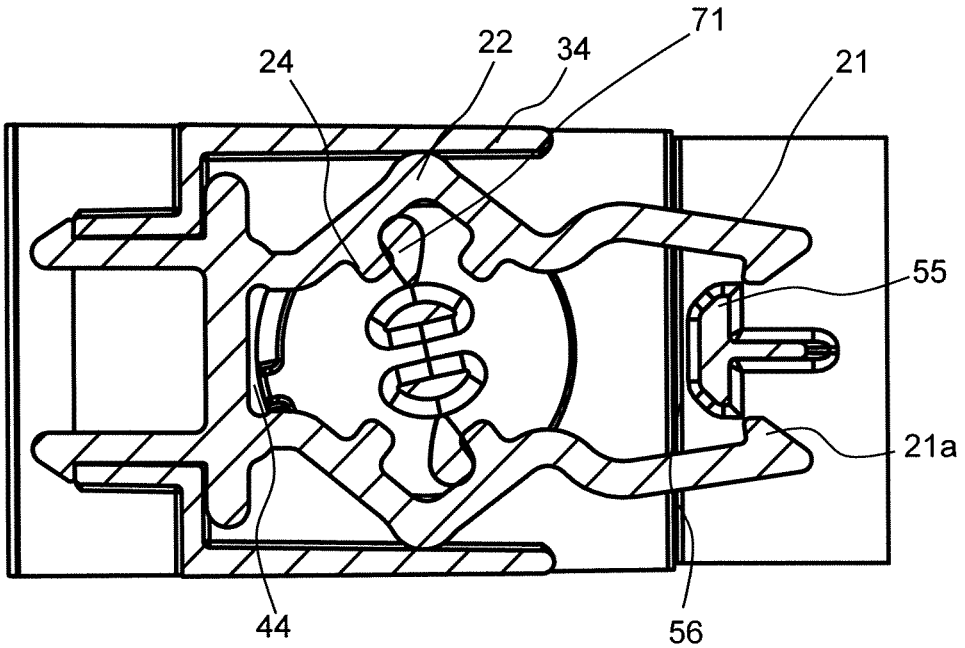
FIG. 7 shows a schematic cross-sectional diagram of the lock mechanism of FIG. 3 when the lock mechanism has been actuated to allow the product dispenser to be opened.

The schematic diagram of FIG. 7 shows when the key 70 has been moved to an actuated position, for example by a user grasping the body 72 of the key and rotating the key, causing the rotatable guiding part to also rotate. When the key is moved to the actuated position, the legs 71 of the key may move along the cam surfaces 23 of the lock arms, forcing the ends of the lock arms to move apart from one another to a disengaged position, releasing the latches 21 from the surfaces 55 of the mating part, and unlocking the lock mechanism. The first and second housing parts may then be separated from one another, i.e. the product dispenser may be opened.

The maximum rotation of the key 70 may be limited by the legs 71 coming to the ends of the cam surfaces 23 and abutting against the stoppers 24 in the actuated position, preventing further movement of the legs 71 along the locking arms, and preventing the legs 21 from separating the ends of the lock arms any further. Accordingly, the stoppers 24 may prevent the lock arms from being flexed excessively, for example beyond their elastic limits.

The length portions 22 and/or the lock arms 20 may also come into contact with the sidewalls 34 of the cradle when the key is moved to the actuated position, preventing the lock arms from being flexed further outwards. The radially outward protrusion 44 may also reach the end of the slot 85 when the key is moved into the actuated position, preventing the rotatable guiding part and the key from begin rotated any further.

The lock mechanism may therefore include three separate arrangements that come into effect when the key is moved into the actuated position to prevent further actuation of the key and damage to the lock mechanism. Specifically, when the key is moved to the actuated position, the legs 71 of the key may move into contact with the stoppers 24, the lock arms 20 may move into contact with the side walls 34, and the radially outward protrusion 44 may move into contact with the end of the slot 85.

Since the legs 71 may be mid-way between the stoppers 24 at the point of greatest distance of the cam surfaces 23 from the stem 46, and the radially outward protrusion 44 may be mid-way along the slot 85, when the key is in the unactuated position, it does not matter whether the key is rotated clockwise or anticlockwise to move the lock arms to the disengaged position. Therefore, there is less risk of damage occurring to the lock mechanism since it is not possible for the user to rotate the key in a wrong direction.

Once the key has been rotated to the actuated position, either fully clockwise or fully anticlockwise, the product dispenser may be opened and the key allowed to rotate back to the unactuated position, allowing the lock arms 20 to flex back towards one another. The spring force of the lock arms 20 acting on the legs 71 may drive the key to move back to the unactuated position when the key is released by the user. The key may then be withdrawn.

The latches 21 may have ramped portions 21*a* that are configured to ramp over guiding surfaces 56 of the mating part 50 as the first and second housing parts are closed together, the ramped portions 21*a* snapping over the guiding surfaces 56 so that the latches 21 engage against the surfaces 55 of the mating part once the first and second housing parts have been fully closed together, locking the first and second housing parts together with one another. Therefore, there may be no need for a key to lock the first and second housing parts together, and so the user may immediately remove the key from the rotatable guiding part once the product dispenser has been opened, without any need for the user to remember to remove the key at a time after the product dispenser has been replenished and closed.

In the illustrated embodiment, the first housing part 11 may be a base for mounting the product dispenser to a wall, and the second housing part 12 may be a cover which can be opened out from the base to enable replacement of the product inside the dispenser. However, in an alternate embodiment the configuration of the lock could be flipped 180 degrees so that the second housing part may be the base for mounting the product dispenser to a wall, and the first housing part may be the cover which can be opened out from the base to enable replacement of the product inside the dispenser. Many other variations of the described embodiments falling within the scope of the invention will also be apparent to those skilled in the art.

The invention claimed is:

1. A product dispenser comprising first and second housing parts and a lock mechanism configured to lock the first and second housing parts together with one another, the lock mechanism comprising:

a cradle, the cradle housing at least one lock arm;

an aperture through the first housing part and leading into the cradle;

a rotatable guiding part located within the aperture and the cradle;

a key that cooperates with the rotatable guiding part; and a mating part of the second housing part, the mating part configured to engage with an end of each lock arm to lock the first and second housing parts together, wherein the key is rotatable to rotate the rotatable guiding part within the aperture and actuate each lock arm to disengage from the mating part, unlocking the first and second housing parts from one another, and wherein the key is separate from the rotatable guiding part and the key comprises at least one leg, each leg configured to press against a respective one of the at least one lock arm to actuate the at least one lock arm.

2. The product dispenser of claim 1, wherein each lock arm comprises a flexible strip of material extending from a base to the end of the lock arm, wherein the base is fixed in position and the end is movable as the flexible strip of material is flexed.

3. The product dispenser of claim 2, wherein the flexible strip of material comprises a length portion that is adjacent to the rotatable guiding part and that is curved to define a cam surface.

4. The product dispenser of claim 3, wherein the length portion comprises a stopper at an end of the cam surface, the stopper configured to prevent camming past the cam surface.

5. The product dispenser of claim 2, wherein the flexible strip of material comprises a length portion that is adjacent to the rotatable guiding part and that is curved to define a cam surface, wherein each leg is configured to cam along the cam surface of the respective lock arm as the key and the rotatable guide part are rotated to flex the end of the lock arm out of engagement from the mating part.

6. The product dispenser of claim 1, wherein the guiding part comprises a disk that locates inside the aperture and a stem that extends from the disk into the cradle, wherein the at least one lock arm comprises two lock arms and the stem is located between the two lock arms.

7. The product dispenser of claim 6, wherein the disk comprises at least one aperture, each aperture configured to receive a respective one of the at least one leg of the key upon insertion of the key into the rotatable guiding part.

8. The product dispenser of claim 6, wherein the at least one leg of the key is configured to reside in the cradle at the exterior of the stem.

9. The product dispenser of claim 6, wherein the disk and aperture comprise a restricting mechanism that is configured to restrict an angular range of rotation of the disk within the aperture.

10. The product dispenser of claim 9, wherein the restricting mechanism comprises a protrusion and a slot, wherein the protrusion is configured to travel along the slot as the disk is rotated, and wherein the slot has an end configured to limit the travel of the protrusion, the limited travel of the protrusion limiting the rotation of the disk.

11. The product dispenser of claim 10, wherein the slot is formed in the first housing part along a perimeter of the aperture and the protrusion is formed as a radially outward protrusion of the disk, or the slot is formed in the disk along a perimeter of the disk and the protrusion is formed as radially inward protrusion of the first housing part into the aperture.

12. The product dispenser of claim 1, wherein the cradle comprises a base wall and two side walls extending perpendicular from the base wall towards the first housing part, the at least one lock arm located between the first housing part and the base wall, and between the two side walls.

13. The product dispenser of claim 12, wherein the guiding part comprises a disk that locates inside the aperture and a stem that extends from the disk into the cradle, wherein the at least one lock arm comprises two lock arms and the stem is located between the two lock arms, and wherein the stem comprises two latch arms that extend through a hole in the base wall and latch against a surface of the base wall adjacent the hole.

14. The product dispenser of claim 12, wherein the side walls block the at least one lock arm from flexing beyond the elastic limit of the at least one lock arm.

15. The product dispenser of claim 12, wherein each lock arm comprises a flexible strip of material extending from a base to the end of the lock arm, wherein the base is fixed in position and the end is movable as the flexible strip of material is flexed, wherein the base of each lock arm comprises at least one latch configured to latch the base in a fixed position within the cradle.

16. The product dispenser of claim 1, wherein the second housing part is configured to overlap with the first housing part on an exterior side of the first housing part when the first and second housing parts are closed together and optionally locked by the lock mechanism.

17. The product dispenser of claim 1, wherein the at least one lock arm comprises two lock arms and wherein the ends of the lock arms each comprise a latch configured to latch against surfaces of the mating part when the surfaces are brought in between the lock arms.

18. A method of manufacturing a product dispenser, the product dispenser comprising first and second housing parts and a lock mechanism configured to lock the first and second housing parts together with one another, the lock mechanism comprising:

a cradle, the cradle housing at least one lock arm, each lock arm having a base and an end opposite from the base;

an aperture through the first housing part and leading into the cradle;

a rotatable guiding part located within the aperture and the cradle;

a key that cooperates with the rotatable guiding part; and a mating part of the second housing part, the mating part configured to engage with an end of each lock arm to lock the first and second housing parts together, wherein the key is rotatable to rotate the rotatable guiding part within the aperture and actuate each lock arm to disengage from the mating part, unlocking the first and second housing parts from one another, wherein the key is separate from the rotatable guiding part and the key comprises at least one leg, each leg configured to press against a respective one of the at least one lock arm to actuate the at least one lock arm, and wherein the method comprises:

providing the first housing part with the cradle;

sliding each lock arm into the cradle until one or more latches at the bases of the at least one lock arm latch against one or more walls of the cradle to hold the bases in a fixed position within the cradle; and sliding the rotatable guiding part through the aperture and into the cradle until the one or more latches of the rotatable guiding part latch against one or more walls of the cradle.

* * * * *